US009580828B2

(12) United States Patent
Moffat et al.

(10) Patent No.: US 9,580,828 B2
(45) Date of Patent: Feb. 28, 2017

(54) SELF-TERMINATING GROWTH OF PLATINUM BY ELECTROCHEMICAL DEPOSITION

(71) Applicant: The United States of America, as represented by the Secretary of Commerce (NIST), Washington, DC (US)

(72) Inventors: Thomas P. Moffat, Gaithersburg, MD (US); Yihua Liu, Gaithersburg, MD (US)

(73) Assignee: The United States of America, as represented by the Secretary of Commerce (NIST), Washington, DC (US)

( * ) Notice: Subject to any disclaimer, the term of this patent is extended or adjusted under 35 U.S.C. 154(b) by 539 days.

(21) Appl. No.: 14/012,830

(22) Filed: Aug. 28, 2013

(65) Prior Publication Data

US 2014/0001049 A1 Jan. 2, 2014

Related U.S. Application Data

(60) Provisional application No. 61/701,818, filed on Sep. 17, 2012.

(51) Int. Cl.
*C25D 3/50* (2006.01)
*C25D 5/18* (2006.01)
(Continued)

(52) U.S. Cl.
CPC ..... *C25D 3/50* (2013.01); *C25D 5/18* (2013.01); *C25D 5/34* (2013.01); *C25D 5/36* (2013.01); *C25D 5/38* (2013.01); *C25D 5/40* (2013.01)

(58) Field of Classification Search
CPC .... C25D 3/00–3/665; C25D 5/00–5/56; C25D 7/00–7/126; C25D 15/00–15/02; C25D 17/00–17/28; C25D 21/00–21/22
See application file for complete search history.

(56) References Cited

U.S. PATENT DOCUMENTS 6,852,635 B2 2/2005 Satta et al.
7,507,495 B2 3/2009 Adzic et al.
(Continued)

OTHER PUBLICATIONS

Jambunathan et al., A Multielectrode Electrochemical and Scanning Differential Electrochemical Mass Spectrometry Study of Methanol Oxidation on Electrodeposited PtxRuy, (20) Langmuir 1856 (2004).*

(Continued)

*Primary Examiner* — James Lin
*Assistant Examiner* — Ho-Sung Chung
(74) *Attorney, Agent, or Firm* — Daphne Burton; Burton IP Law Group

(57) ABSTRACT

A self-terminating rapid process for controlled growth of platinum or platinum alloy monolayer films from a $K_2PtCl_4$—NaCl—NaBr electrolyte. Using the present process, platinum deposition may be quenched at potentials just negative of proton reduction by an alteration of the double layer structure induced by a saturated surface coverage of underpotential deposited hydrogen. The surface may be reactivated for platinum deposition by stepping the potential to more positive values where underpotential deposited hydrogen is oxidized and fresh sites for absorption of platinum chloride become available. Periodic pulsing of the potential enables sequential deposition of two dimensional platinum layers to fabricate films of desired thickness relevant to a range of advanced technologies, from catalysis to magnetics and electronics.

16 Claims, 8 Drawing Sheets

(51) Int. Cl.

| | |
|---|---|
| *C25D 5/34* | (2006.01) |
| *C25D 5/36* | (2006.01) |
| *C25D 5/38* | (2006.01) |
| *C25D 5/40* | (2006.01) |

(56) References Cited

U.S. PATENT DOCUMENTS

| | | | |
|---|---|---|---|
| 7,611,751 | B2 | 11/2009 | Elers |
| 7,632,601 | B2 | 12/2009 | Adzic et al. |
| 7,704,918 | B2 | 4/2010 | Adzic |
| 7,704,919 | B2 | 4/2010 | Adzic et al. |
| 7,972,977 | B2 | 7/2011 | Wang et al. |
| 8,048,548 | B2 | 11/2011 | Adzic et al. |
| 8,062,552 | B2 | 11/2011 | Adzic |
| 8,080,280 | B1 | 12/2011 | Grubbs |
| 8,268,409 | B2 | 9/2012 | Elers et al. |
| 8,283,485 | B2 | 10/2012 | Norman |
| 8,308,989 | B2 | 11/2012 | Adzic et al. |
| 8,404,613 | B2 | 3/2013 | Adzic et al. |
| 2010/0097742 | A1 | 4/2010 | Adzic |
| 2010/0099012 | A1 | 4/2010 | Adzic |
| 2010/0123993 | A1 | 5/2010 | Laor |
| 2012/0207944 | A1 | 8/2012 | Finch |

OTHER PUBLICATIONS

F. T. Wagner, R. Lakshmanan, M. F. Mathias, Electrochemistry and the future of the automobile. J. Phys. Chem. Lett. 1, 2204 (2010).
M. K. Debe, Electrocatalyst approaches and challenges for automotive fuel cells. Nature 486, 43 (2012).
I. Horcas et al., WSXM: A software for scanning probe microscopy and a tool for nanotechnology. Rev. Sci. Instrum. 78, 013705 (2007).
V. R. Stamenkovic et al., Trends in electrocatalysis on extended and nanoscale Pt-bimetallic alloy surfaces. Nat. Mater. 6, 241 (2007).
R. R. Adzic et al., Platinum monolayer fuel cell electrocatalysts. Top. Catal. 46, 249 (2007).
A. Bergbreiter, O. B. Alves, H. E. Hoster, Entropy effects in atom distribution and electrochemical properties of AuxPt1-x/Pt(111) surface alloys. ChemPhysChem 11, 1505 (2010).
H. F. Waibel, M. Kleinert, L. A. Kibler, D. M. Kolb, Initial stages of Pt deposition on Au(111) and Au(100). Electrochim. Acta 47, 1461 (2002).
T. Kondo et al., Resonance surface X-ray scattering technique to determine the structure of electrodeposited Pt ultrathin layers on Au(111) surface. Electrochim. Acta 55, 8302 (2010).
I. Bakos, S. Szabo, T. Pajkossy, Deposition of platinum monolayers on gold. J. Solid State Electrochem. 15, 2453 (2011).
S. R. Brankovic, J. X. Wang, R. R. Adzic, Metal monolayer deposition by replacement of metal adlayers on electrode surfaces. Surf. Sci. 474, L173 (2001).
D. Gokcen, S.-E. Bae, S. R. Brankovic, Reaction kinetics of metal deposition via surface limited redox replacement of underpotentially deposited metal monolayers. Electrochim. Acta 56, 5545 (2011).
A. J. Gregory, W. Levason, R. E. Noftle, R. Le Penven, D. Pletcher, Studies of platinum electroplating baths Part III. The electrochemistry of Pt(NH3)4—x(H2O)2+2 and PtCl4—x(H2O)(2-x)-x. J. Electroanal. Chem. 399, 105 (1995).
N. Garcia-Araez, V. Climent, E. Herrero, J. Feliu, J. Lipkowski, Determination of the Gibbs excess of H adsorbed at a Pt(111) electrode surface in the presence of co-adsorbed chloride. J. Electroanal. Chem. 582, 76 (2005).
D. Strmcnik, D. Tripkovic, D. van der Vliet, V. Stamenkovic, N. M. Markovic, Adsorption of hydrogen on Pt(111) and Pt(100) surfaces and its role in the HOR. Electrochem. Commun. 10, 1602 (2008).
T. Roman, A. Groβ, Structure of water layers on hydrogen-covered Pt electrodes. Cataly. Today, http://dx.doi.org/10.1016/j.cattod.2012.06.001 (2012).
G. Jerkiewicz, G. Vatankhah, S. Tanaka, J. Lessard, Discovery of the potential of minimum mass for platinum electrodes. Langmuir 27, 4220 (2011).
P. J. Cumpson, M. P. Seah, Elastic scattering corrections in AES and XPS. II. Estimating attenuation lengths and conditions required for their valid use in overlayer/substrate experiments. Surf. Interface Anal. 25, 430 (1997).
M. O. Pedersen et al., How a gold substrate can increase the reactivity of a Pt overlayer. Surf. Sci. 426, 395 (1999).
Y. Nagahara et al., In situ scanning tunneling microscopy examination of molecular adlayers of haloplatinate complexes and electrochemically produced platinum nanoparticles on Au(111). J. Phys. Chem. B 108, 3224 (2004).

* cited by examiner

SELF-TERMINATING GROWTH OF PLATINUM BY ELECTROCHEMICAL DEPOSITION

CROSS-REFERENCE TO RELATED APPLICATIONS

The present application claims priority to provisional application Ser. No. 61/701,818, filed on or about Sep. 17, 2012, entitled "Atomic Layer Deposition of Pt from Aqueous Solutions" naming the same inventors as in the present application. The contents of this provisional application are incorporated by reference, the same as if fully set forth.

STATEMENT REGARDING FEDERALLY SPONSORED RESEARCH/DEVELOPMENT

The subject matter of this patent application was invented under the support of at least one United States Government contract. Accordingly, the United States Government may manufacture and use the invention for governmental purposes without the payment of any royalties.

BACKGROUND OF THE INVENTION

Field of Invention

The present disclosure relates to electrochemical deposition and, more particularly, to self-terminating growth of platinum by electrochemical deposition.

Description of Related Art

Platinum has been used as a key constituent in a number of heterogeneous catalysts. However, because platinum is expensive, its use in the development of alternative energy conversion systems—such as low temperature fuel cells—has been somewhat limited. In the meantime, strategies are being explored to minimize platinum loadings, while also enhancing catalyst performance. The strategies range from alloying to nanoscale engineering of core-shell and related architectures that may involve spontaneous processes such as dealloying and segregation to form platinum-rich surface layers.

Deposition of two-dimensional (2-D) platinum layers is of interest in areas such as thin film electronics, magnetic materials, electrocatalysts, and catalytically active barrier coating for corrosion management. Such two-dimensional deposition is non-trivial because the step-edge barrier to interlayer transport results in roughening or three-dimensional mound formation. The chemical and electronic nature of the Pt films may also be a function of its roughness, thickness and the underlying substrate.

In situ scanning tunnel microscopy (STM) has been used to analyze platinum electrodeposition. When platinum is electrodeposited onto gold at moderate overpotentials, STM reveals how the metal nucleation and growth proceeds on gold. More particularly, STM shows that this nucleation and growth proceeds by formation of three-dimensional clusters at defect sites on single crystal surfaces. At small overpotentials, smooth platinum monolayers may be electrodeposited on gold with a long growth time, e.g., two thousand (2,000) seconds. X-ray scattering may be used to confirm this smoothness. Voltammetric studies may show a potential-dependent transition between two-dimensional islands versus three-dimensional multilayer growth. However, only partial platinum monolayer coverage may be obtained in the two-dimensional growth regime.

There is a need for a process for electrodepositing a platinum monolayer that results in better coverage in the two-dimensional growth regime.

To address these difficulties, surface limited place exchange reactions are being explored. Galvanic displacement of an underpotential deposited metal monolayer, e.g., copper, may occur by the desired platinum group metal, with the exchange resulting in a sub-monolayer coverage of the noble metal. The process may be repeated to form multiple layers using a variant, electrochemical atomic layer epitaxy. This process may require an exchange of electrolytes and some care to control the trapping of less noble metal as a minor alloying constituent within the film. There is a need for a deposition process that addresses these shortcomings.

In addition, a drawback of some prior art underpotential deposition (upd) reactions is that many of such reactions may be reversed. These reversals make it difficult to control deposition processes, especially when considering sub-nanometer scale films. To avoid the reversibility issues, irreversible processes like vapor phase deposition of thin films at low temperatures may be used. Robust additive fabrication schemes may facilitate these irreversible processes. However, a shortcoming of this approach is that kinetic factors may constrain the quality of the resulting films.

There remains a need for a process for depositing high coverage ultrathin (monolayer thick) platinum films and alloys thereof, so that kinetic factors do not constrain the quality of the resulting films.

BRIEF SUMMARY OF DISCLOSURE

The present disclosure addresses the needs described above by providing a method for self-terminating growth of platinum by electrochemical deposition. In accordance with one embodiment of the present disclosure, a method is provided for self-terminating growth of platinum or platinum alloy by electrochemical deposition. The method comprises, in the aqueous solution, electrodepositing platinum or a platinum alloy onto a substrate such that a saturated underpotential deposited hydrogen layer is formed on the substrate. As the potential moves negative of an onset of proton reduction potential, a metal deposition reaction among the deposited platinum, the hydrogen layer and the aqueous solution is fully quenched or terminated. The aqueous solution contains at least platinum salt.

The method further comprises pulsing the potential from a first value, a positive value at which no metal deposition occurs, to a second value, said second value being a more negative value than the first value, said second value being at least 0.05 V more negative or below the reversible hydrogen electrode potential of said solution, thus enabling formation on the substrate of two-dimensional platinum islands that substantially cover the substrate, said formation being followed by negligible further metal deposition on the substrate.

In accordance with another embodiment of the present disclosure, a platinum or platinum alloy monolayer product manufactured according to this process is provided.

These, as well as other objects, features and benefits will now become clear from a review of the following detailed description of illustrative embodiments and the accompanying drawings.

DETAILED DESCRIPTION OF THE DISCLOSURE

Figure 1A:
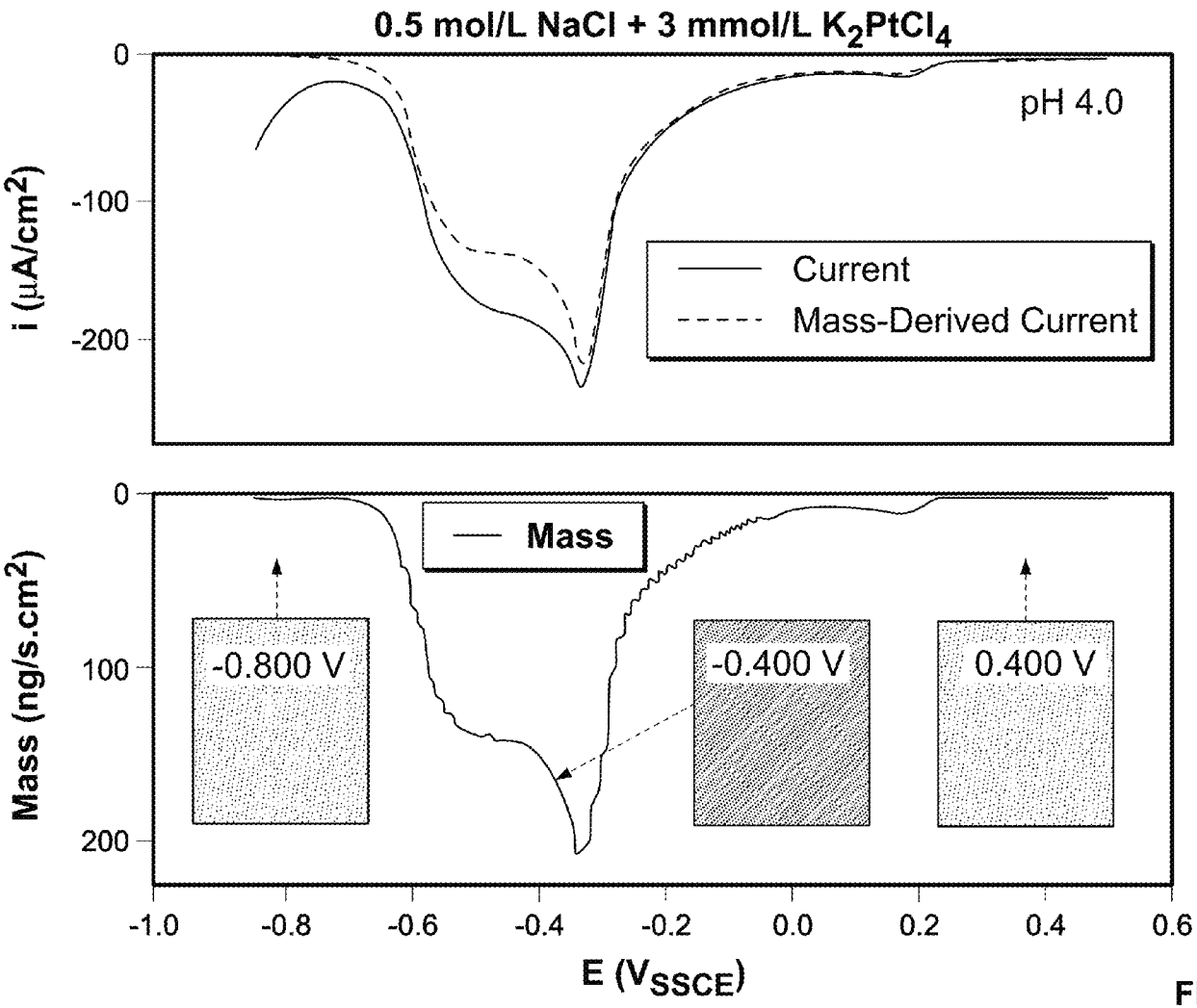
FIG. 1A is a graphical representation of gravimetric and voltammetric measurements (2 mV/s) of platinum deposition from a NaCl—$PtCl_4^{2-}$ solution using a static electrochemical quartz crystal microbalance (EQCM).

A process is described for self-terminating growth of platinum or related platinum transition metal alloys by electrochemical deposition. The platinum transition metal alloys may include Ni, Co, Fe, Cu, Pb, Ru, Ir, etc. Platinum or platinum alloy monolayers grown using this self-terminating process are also described herein. In accordance with the present disclosure, it is shown that formation of a saturated underpotential deposited hydrogen layer and its effect in the electrical double layer may exert a remarkable quenching or self-terminating effect on platinum deposition, restricting it to a high coverage of two-dimensional platinum islands. When repeated, by using a pulsed potential waveform to periodically oxidize the underpotential deposited hydrogen layer, sequential deposition of platinum or platinum alloy layers may be achieved. A potentiostat and wave form generator maybe used to control and implement the potential waveform. Convolution with the electrochemical cell time constant maybe used to further influence the film growth. The cell time constant may be adjusted by varying the separation between the working and reference electrodes (or otherwise changing cell dimensions), or by altering the conductivity of the electrolyte by changing the supporting electrolyte concentration.

Platinum deposition experiments were performed in connection with the present disclosure at room temperature in aqueous solutions of 0.5 moles per liter (mol/L) salt (NaCl) and 0.003 mol/L potassium tetrachloroplatinate ($K_2PtCl_4$) with pH values ranging from 2.5 to 4. However, it should be understood that this electrolyte is non-limiting. For example, in connection with the present disclosure, self-terminating platinum deposition was observed over a wide range of pH and halide concentrations. Moreover, it was not dependent on the oxidation state ($2^+$, $4^+$) of the platinum halide precursors. Moreover, additional solutions may serve as the aqueous solution, including but not limited to, platinum (II) and/or (IV) complexes with a variety of ligands, from halides, to amines to nitro, sulphato or hydroxyl groups that are used in the presence of a supporting electrolyte comprised of the alkali or alkaline earth salts with typically the same anions as the ligand used in the Pt precursor. This is done to stabilize the speciation of the Pt ion precursor. The dynamics of conventional Pt deposition are affected by such choices. However, the self-terminated growth behavior still applies to all of these electrolytic systems. In one embodiment, a high NaCl concentration is used to stabilize the Pt(II) as the tetrachloro species, i.e. $PtCl_4^{2-}$, and to maximize the conductivity of the electrolyte and thereby minimize the electrochemical cell time constant. In some embodiments, the pH value of the aqueous solution is in the range of 1.0 to 14.0

The aqueous solution may include at least one Pt salt which may be a Pt(II) salt in a concentration of 0.0001 mol/L to 0.05 mol/L as a metal source, and a supporting electrolyte may be an alkali tetrahalideplatinate such as alkali, or alkaline earth or halide in a concentration of 0 mol/L to 3 mol/L or up to saturation. In one embodiment the aqueous solution may include chloride salts, although bromide salts may also be used. The respective salts can range from sub-micromolar concentrations up to the solubility limit.

Alternatively, the aqueous solution may include a Pt(IV) salt in a concentration of 0.0001 mol/L to 0.01 mol/L and the aqueous solution may further include a supporting electrolyte comprised of one of more alkali or alkaline earth salts in a concentration of 0 mol/L to 3 mol/L or up to saturation.

A wide range of buffer solutions may be added to the electrolyte congruent with those practiced by those familiar with the art. Phosphate is an example of such a buffer.

In order to isolate the partial current associated with only the growth process, an electrochemical quartz crystal microbalance (EQCM) may be used to track metal deposition on a metal electrode as the potential is swept in the negative direction. In one embodiment, the most negative potential is constrained to lie within 500 mV of the reversible hydrogen electrode potential in order to minimize the excess hydrogen generated at the electrode. Referring now to FIG. 1A, illustrated is a graphical representation of gravimetric and voltammetric measurements (2 mV/s) of platinum deposition from a NaCl—$PtCl_4^{2-}$ solution using a static EQCM in accordance with one embodiment of the present disclosure.

Voltammetry in FIG. 1A shows the onset of platinum deposition at 0.25 $V_{ssce}$, where SSCE refers to a saturated sodium chloride calomel ($NaCl_{sat'd}/Hg_2Cl_2/Hg$) reference electrode. The onset of platinum deposition is followed by a significant current rise to a maximum of −0.32 $V_{ssce}$ that is close to diffusion-limited $PtCl_4^{2-}$ reduction. As shown, the deposition rate decreases smoothly after the peak as the mass transfer boundary layer thickness expands. A sharp drop in the current occurs in this example as the potential moves negative of −0.5 $V_{ssce}$, eventually reaching a minimum near −0.7 $V_{ssce}$. At more negative potentials, an increase is shown due to hydrogen evolution from water. The gravimetrically determined (EQCM) metal deposition rate shows that the sharp drop below −0.5 $V_{ssce}$ coincides with complete quenching of metal deposition. This self-termination or passivation process occurs despite the large overpotential (>1 V) available for driving the deposition reaction. Self termination is clearly evident below −0.7 $V_{SSCE}$.

The gravimetric data is used to reconstruct the partial voltammogram for platinum deposition—a two-electron process. Good agreement exists between the measured voltammogram and the reconstructed partial voltammogram for platinum deposition. Thus, it appears that the current efficiency of platinum deposition is close to one hundred percent (100%) as the potential is swept toward the diffusion-limited value. Nearing the current peak, an apparent loss in efficiency may be observed, due to non-uniform deposition that develops as the $PtCl_4^{2-}$ depletion gradient sets up a convective flow field that spans the static EQCM electrode.

Figure 1B:
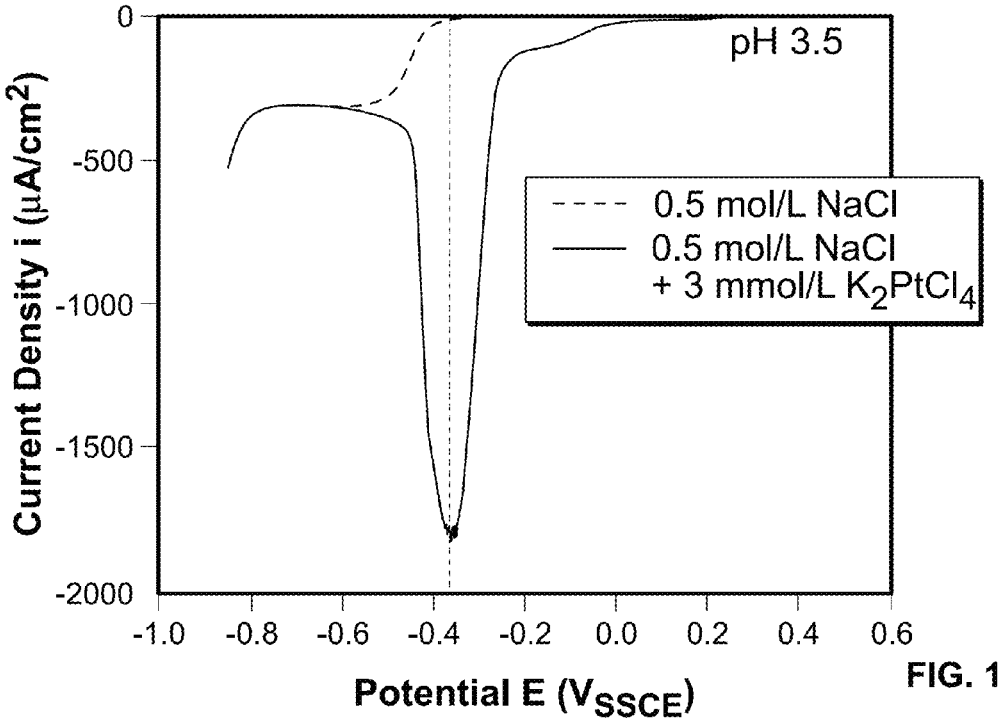
FIGS. 1B, 1C and 1D are graphical representations of voltammetric measurements (2 mV/s) of platinum deposition from a NaCl—$PtCl_4^{2-}$ solution using a gold rotating disk electrode (RDE) at 400 rpm and that of background reactions from a NaCl solution using a platinum RDE at the same rotation rate.

Referring now to FIG. 1B, illustrated is a graphical representation of voltammetric measurements (2 mV/s) of platinum deposition from a NaCl—$PtCl_4^{2-}$ solution using a gold rotating disk electrode (RDE) at 400 rpm. By contrast to the EQCM embodiment of FIG. 1A, voltammetry with a rotating disk electrode (RDE) as shown in FIG. 1B provides uniform mass transport, resulting in a more symmetric peak. The proton reduction reaction is isolated by performing voltammetry in the absence of the platinum complex. Merging the respective voltammograms at negative potentials indicates that the quenching of the metal deposition reaction is coincident with the onset of the $H_2$ evolution reaction. The overlap of the diffusion-limited proton reduction also indicates the absence of significant homogeneous reaction between the generated $H_2$ and $PtCl_4^{2-}$. Thus, it appears that a homogeneous reaction that scavenges the incoming $Pt^{2+}$ complex can be excluded as an explanation for the quenching of the platinum deposition reaction. The two-electron reduction of $PtCl_4^{2-}$ to platinum is not expected to depend on pH.

Figure 1C:
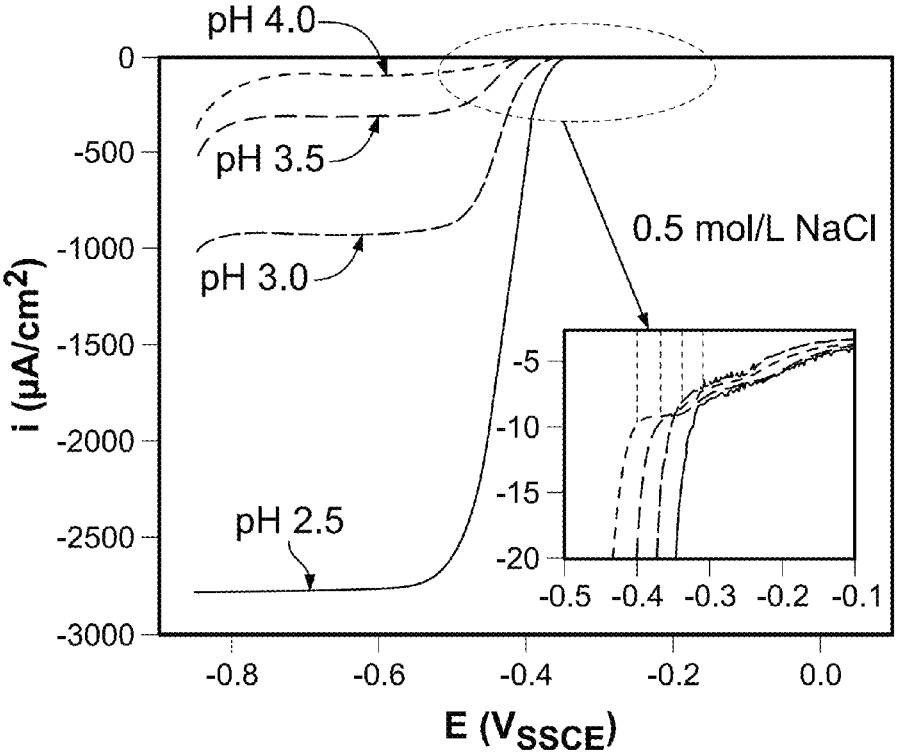
Figure 1D:
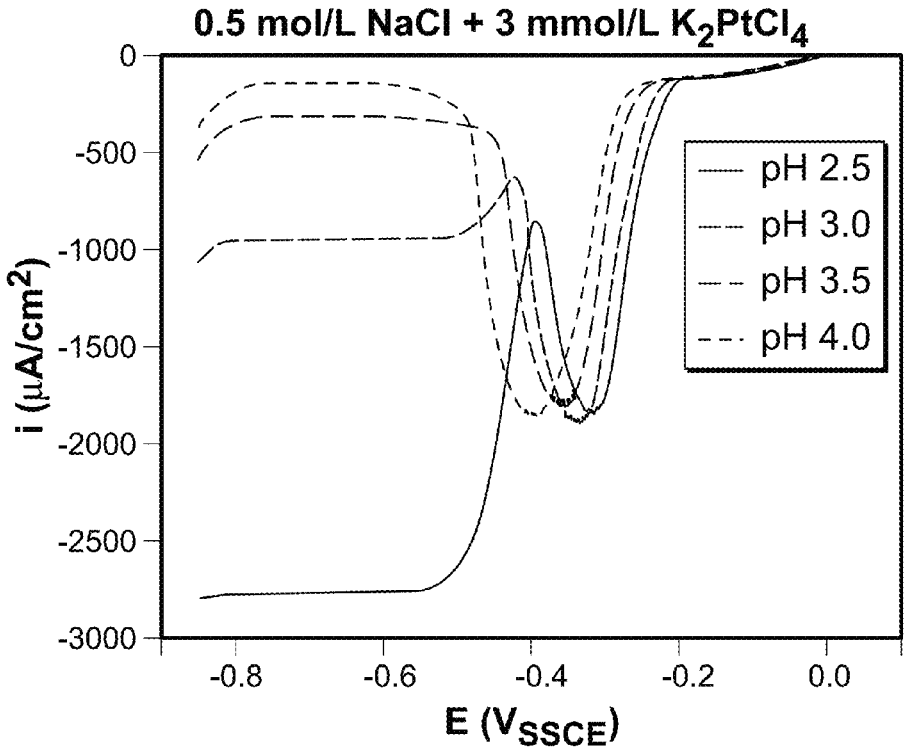

Moving now to FIG. 1D, shown is another graphical representation of voltammetric measurements (2 mV/s) of platinum deposition from a NaCl—$PtCl_4^{2-}$ solution using a gold rotating disk electrode (RDE) at 400 rpm. As shown in FIG. 1D, the onset of significant platinum deposition occurs from $PtCl_4^{2-}$ to Pt at 0.0 $V_{SSCE}$, thus supporting the conclusion that the two-electron reduction of $PtCl_4^{2-}$ to platinum does not depend on pH.

By contrast, the deposition rate below −0.2 $V_{SSCE}$ is pH-dependent. As shown in FIG. 1C, the sharp acceleration of the deposition rate correlates with the onset of underpotential hydrogen deposition evident in $PtCl_4^{2-}$-free voltammetry. Chronocoulometry studies indicate that the transition between a halide and a hydrogen-covered platinum surface occurs in the same region where the deposition rate accelerates in FIG. 1C. The metal deposition rate increases with underpotential deposited hydrogen coverage having a peak value that is independent of pH. Meanwhile, the peak potential shifts by −0.059 V/pH, reflecting the importance of hydrogen surface chemistry in controlling the platinum deposition process. The onset of proton reduction in the absence of $PtCl_4^{2-}$, shown by the dotted line in FIG. 1B, occurs at essentially the same potential. Thus, the peak deposition rate occurs at the hydrogen reversible potential. Moving to more negative potentials, the metal deposition rate declines rapidly and within 0.1 V of its peak value the current merges with that attributable solely to diffusion-limited proton reduction, indicating complete quenching of the platinum deposition reaction.

Importantly, transient studies of adsorbed hydrogen ($H_{ads}$) on platinum indicate that the coverage does not reach saturation at the reversible hydrogen potential but rather occurs 0.1 V below the reversible value. This is precisely the potential regime where the metal deposition reaction is fully quenched. Cyclic voltammetry shows that the passivation process is reversible with reactivation coincident with the onset of underpotential deposited hydrogen oxidation.

Figure 1E:
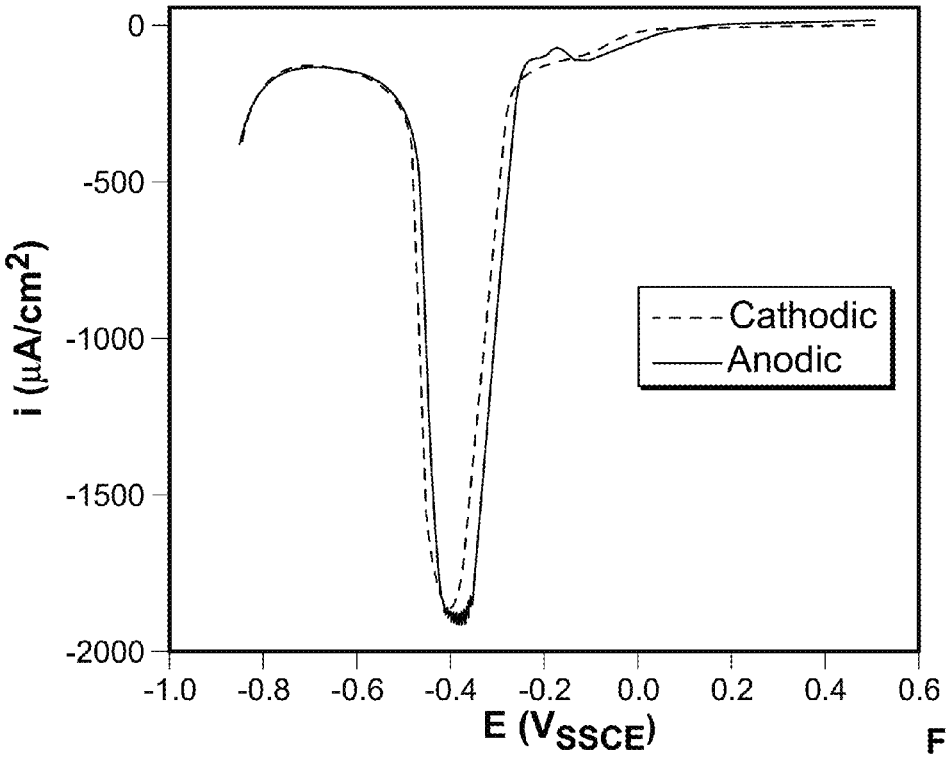
FIG. 1E is a graphical representation of cyclic voltammetry showing the reversible nature of suppressed and reactivated platinum deposition

Referring now to FIG. 1E, illustrated is a graphical representation of cyclic voltammetry showing the reversible nature of suppressed and reactivated platinum deposition from a solution of 0.5 mol/L NaCl+0.003 mol/L $K_2PtCl_4$ (400 rpm, 2 mV/s). The solution has a pH of 3.5.

Self-termination of the metal deposition reaction arises from perturbation of the double layer structure that accompanies $H_{ads}$ saturation of the platinum surface. The water structure next to a hydrogen covered platinum (111) surface may be significantly altered with the centroid of the oxygen atoms within the first water layer being displaced by more than 0.1 nanometer (nm) from the metal surface as the water-water interactions in the first layer become stronger. This topic was discussed in a 2013 article titled "Structure of water layers on hydrogen-covered Pt electrodes" by T. Roman and A. Gross that was published in *Catalysis Today* at vol. 202, pages 183-190.

An EQCM study of platinum in sulfuric acid has identified "potential of minimal mass" near the reversible potential of hydrogen reactions. This study was discussed in an article by G. Jerkiewicz, G. Vantankhah, S. Tanaka, and J. Lessard published at vol. 27, page 4220-4226 of the publication *Langmuir*. The gravimetric measurements reflect the impacts of underpotential deposited hydrogen on the adjacent water structure that leads to a minimum in coupling between the electrode and electrolyte, consistent with the recent theoretical result, as discussed by T. Roman and A. Gross in the publication *Catalysis Today* at vol. 202, pages 183-190. In addition to underpotential deposited hydrogen perturbation of the water structure, the quenching of metal deposition reaction occurs at potentials negative of the platinum point of zero charge wherein anions would have been desorbed. This combination exerts a remarkable effect such that $PtCl_4^{2-}$ reduction is completely quenched while diffusion-limited proton reduction continues unabated.

Self-terminating platinum deposition was examined under potentiostatic conditions. Referring to the insets in FIG. 1A, optical micrographs of a selection of films after five hundred (500) seconds of deposition at various potentials are illustrated. Only the lower half of the gold-coated silicon (100) wafer was immersed in solution with differences in reflectivity and color indicating the anomalous dependence of deposition on potential. A thirty-three (33) nm thick platinum film was deposited at −0.4 $V_{SSCE}$, and a nearly invisible much thinner layer was grown at −0.8 $V_{SSCE}$.

Figure 2:
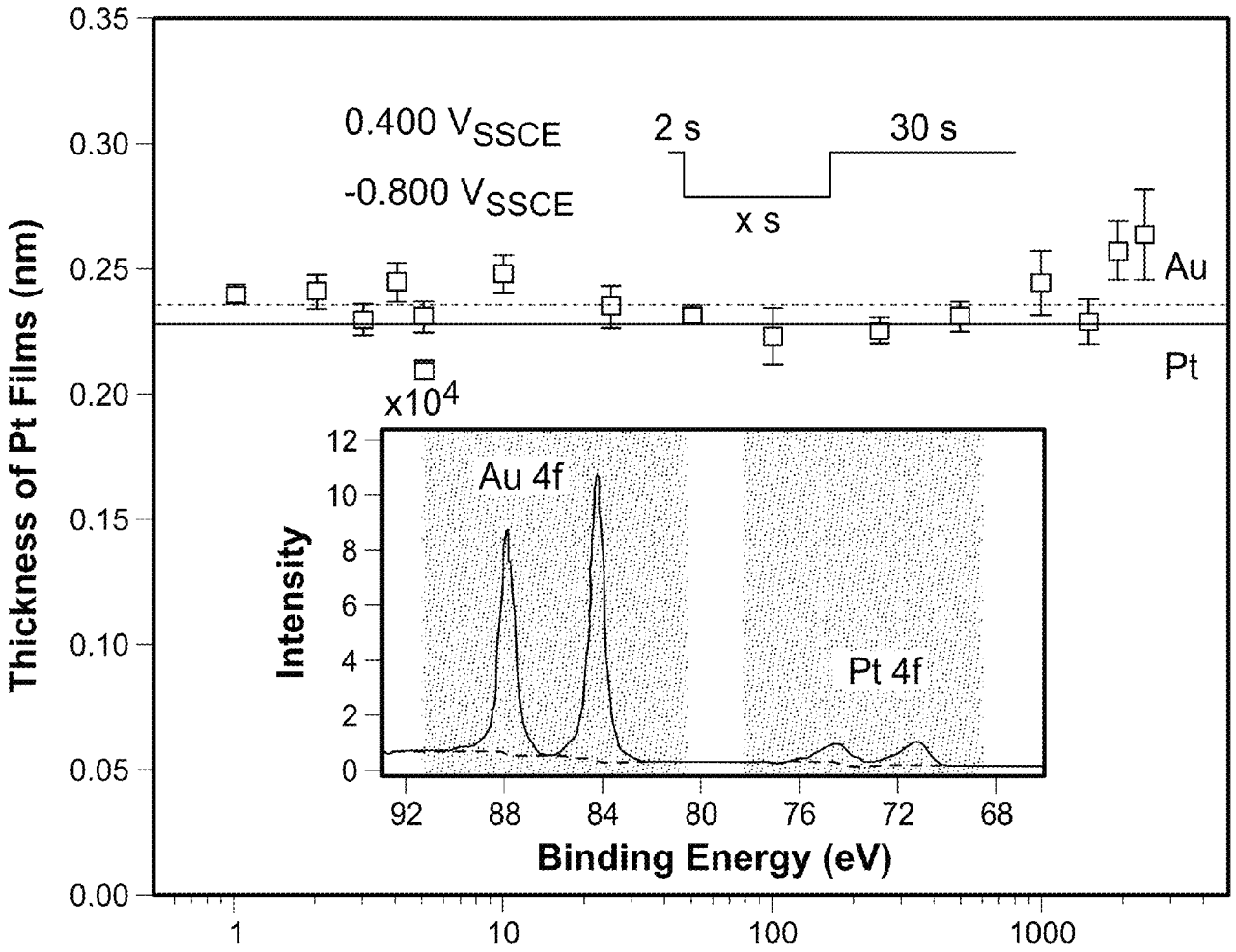
FIG. 2 is a graphical representation of a typical X-ray photoelectron spectra—and the derived thickness (squares) of platinum films as a function of deposition time at −0.8 $V_{SSCE}$ on gold-coated silicon wafers from a pH=4 solution.

X-ray photoelectron spectroscopy may aid in further quantifying the composition and thickness of platinum grown as a function of deposition time and potential on (111) textured gold. Referring now to FIG. 2, illustrated is a graphical representation of typical X-ray photoelectron spectra—and the derived thicknesses (squares) of platinum films as a function of deposition time as derived from X-ray photon spectroscopy. The deposition occurred at a potential of −0.8 $V_{SSCE}$ on gold-coated silicon wafers from a pH 4 solution. For films deposited at −0.8 $V_{SSCE}$, shown in FIG. 2 is a representative spectrum with the 4f doublets for metallic states of Au and Pt. The ratio of the platinum and gold peak areas was used to calculate the platinum thickness, assuming it forms a uniform overlayer. For deposition times up to one thousand (1000) seconds, the measured thickness varies between 0.21 nm and 0.25 nm, congruent with the deposition of a platinum monolayer with a thickness comparable to the (111) d-spacing of platinum. Monolayer formation may be complete within the first second of stepping the potential to −0.8 $V_{SSCE}$. Because no further growth occurs, the deposition reaction process self-terminates. When a thin layer of platinum is deposited onto a substrate, this platinum may be more or less catalytic than pure platinum depending on the substrate and reaction in question. A key requirement for deposition is that the materials be conductive or in the case of semiconductors and oxides either thin enough to allow electron tunneling or be photoconductive. Effective two dimensional nucleation and growth is favored by substrates that adsorb the ionic Pt precursor, e.g., Ni and Ni-based alloys, stainless steel, Au, Ag, and other substrates. The substrate material may be an iron group or an alloy thereof. Iron group metals include iron, cobalt and nickel. Alternatively, the substrate material may be gold silver, or copper, or an alloy thereof. As yet another option, the substrate material may be platinum group metals or alloys thereof. As still yet another option, the substrate material may be chromium, tungsten, molybdenum or alloys thereof.

For thin oxide-covered surfaces, a variety of surface pretreatments such as etching in acid (HF) or base (KOH), may be required to remove the oxide and facilitate adsorption of the ionic Pt precursor on the substrate. Oxide-covered metallic electrodes may be made suitable for Pt electrodeposition by etching in fluoride, acid or basic media to remove or minimize the oxide coverage consistent with existing treatments well known to those practiced in the art. As the platinum monolayers become thicker, the platinum behaves more like pure platinum.

After 1000 seconds, an additional increment of platinum deposition becomes apparent. Inspection of the surface with scanning electron microscopy showed a sparse coverage of spherically shaped platinum particles on the surface due to $H_2$-induced precipitation, a process requiring some heterogeneity and extended incubation to nucleate. Particle formation may be avoided by using shorter deposition times or higher supporting electrolyte (e.g. NaCl) concentrations to ensure that the dominant precursor (e.g. $PtCl_4^{2-}$) complex is the most resistant to homogenous reduction by $H_2$.

Figure 3A:
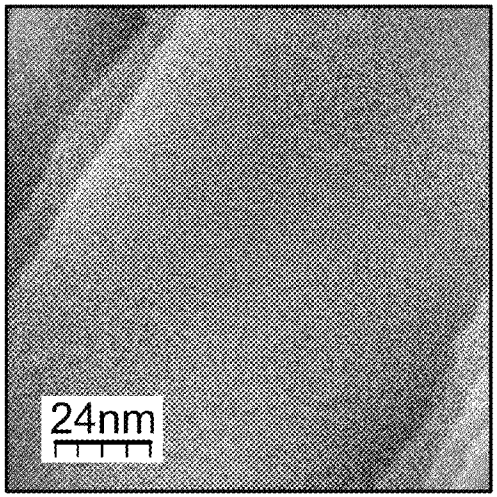
FIG. 3A is an STM image of a representative gold surface with monoatomic steps.

In FIGS. 3A through 3F, scanning tunneling microscopy (STM) was used to directly observe the platinum overlayer morphology. Analysis may be facilitated by using a flame annealed gold (111) surface with isolated surface steps that serve as fiduciary markers, the steps being 0.24+/−0.02 nm in height. Referring to FIG. 3A, illustrated are STM images of representative gold surface with monoatomic steps.

Figure 3B:
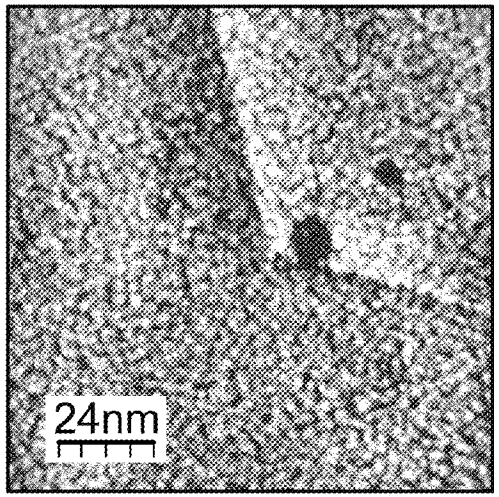
FIG. 3B is an STM image of two-dimensional platinum layers obtained after 5 second deposition at −0.8 $V_{ssce}$.

Moving now to FIG. 3B, platinum deposition results in three distinct levels of contrast that reflect the surface height with the lowest level being the original gold terraces. As shown in FIG. 3B, platinum deposition results in three distinct levels of contrast that reflect the surface height with the lowest level being the original gold terraces.

Figure 3C:
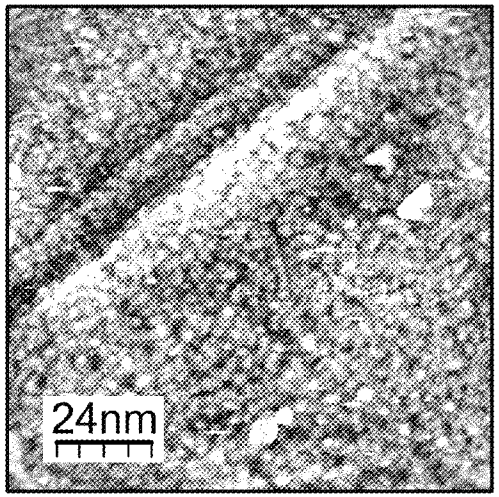
FIG. 3C is an STM image of two-dimensional platinum layers obtained after 500 second deposition at −0.8 $V_{ssce}$.

Referring now to FIG. 3C, shown is an STM image of two-dimensional platinum layers obtained after 500 second deposition at −0.8 $V_{ssce}$. As shown, the same three-level structure is observed independently of deposition time up to 500 seconds. The middle contrast level shows a high density of platinum islands that cover about eighty-five percent (85%) of the gold surface with a step height of about 0.24 nm consistent with results from X-ray photoelectron spectroscopy.

Figure 3D:
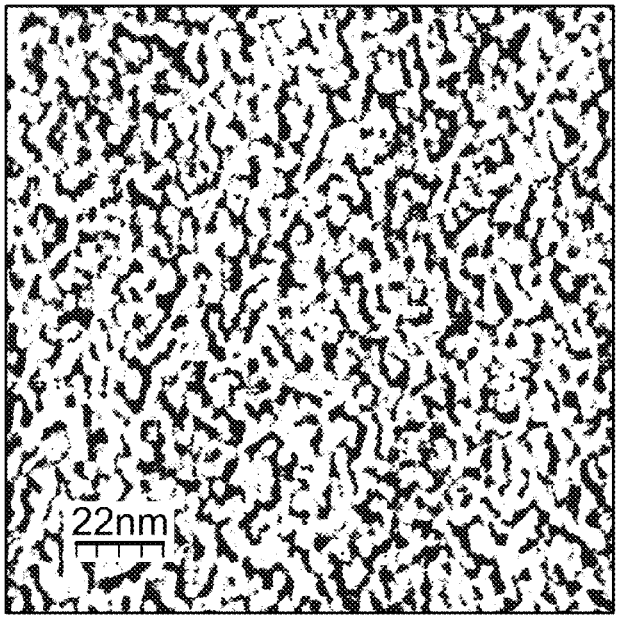
FIG. 3D is a high-contrast image of two-dimensional platinum morphology on gold (Au(111)).

Referring now to FIG. 3D, shown is a high-contrast image of two-dimensional platinum morphology on gold (Au (111)). Inspection using this higher rendering contrast shows that about ten percent (10%) coverage of a second layer of small platinum islands with a step height ranging between 0.23 nm to 0.26 nm. Step positions associated with the flame annealed substrate are preserved with negligible expansion or overgrowth of the two-dimensional platinum islands occurring beyond the original step edge. The lateral span of the platinum islands lies in the range of 2.02+/−0.38 nm corresponding to an area of 4.23+/−1.97 $nm^2$. Incipient coalescence of the islands is constrained by the surrounding narrow channels that are 2.1+/−0.25 nm wide. These channels account for the remaining platinum-free portion of the first layer. The reentrant channels correspond to open gold terrace sites that are surrounded by adjacent platinum islands in what amounts to a huge increase in step density relative to the original substrate. The net geometric or electronic effect of this increase is to block further platinum deposition.

Figure 3E:
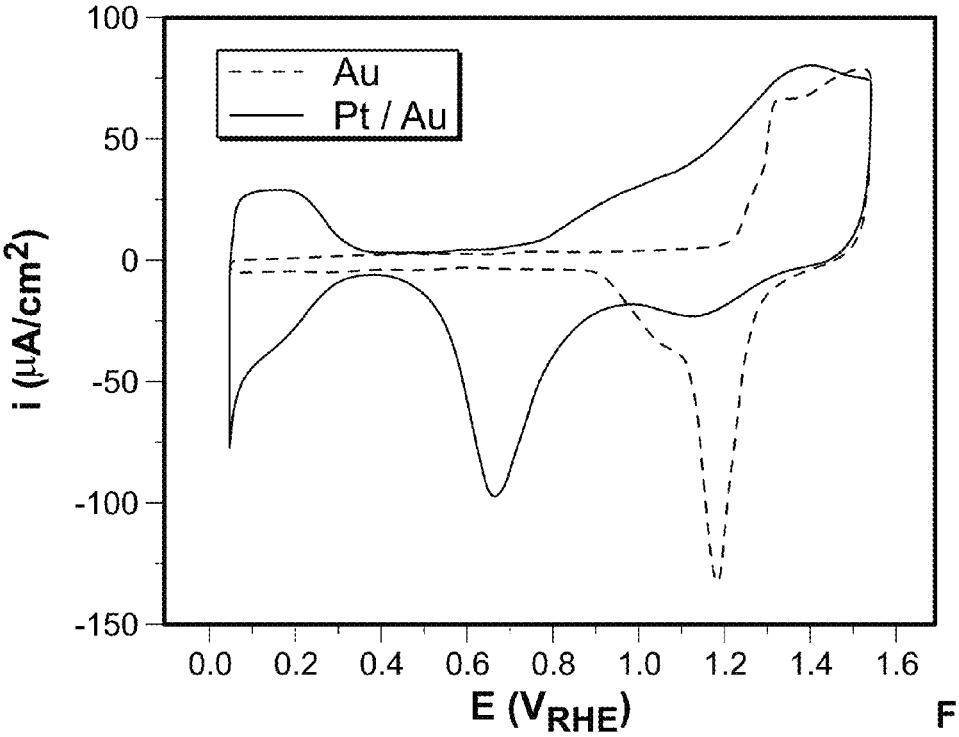
FIG. 3E is a graph showing cyclic voltammetry that shows $H_{UPD}$ and oxide formation and reduction on gold-coated silicon surfaces before and after the growth of a platinum monolayer.

The chemical nature of the inter-island region is assayed by exploiting the distinctive voltammetry of platinum and gold with respect to underpotential deposited hydrogen and oxide formation and reduction detailed in FIG. 3E. Referring now to FIG. 3E, illustrated is a graph showing cyclic voltammetry that shows underpotential deposited hydrogen, oxide formation and oxide reduction on gold-coated silicon surfaces before and after the growth of a platinum monolayer. In 0.1 mol/L $HClO_4$ underpotential deposited hydrogen features are evident between 0.050 $V_{RHE}$ and 0.400 $V_{RHE}$. As shown in FIG. 3E, the wave's shape is consistent with that for platinum (111) although the magnitude 108 $\mu C/cm^2$+/−5 is less than 146 $\mu C/cm^2$ because of finite side effects. These results are similar to that of underpotential deposited hydrogen for platinum-rich $Pt_{1-x}Au_{1-x}$ surface alloys grown on platinum (111) reported in publication *ChemPhysChem* at vol. 11, page 1505-1512 (2010) by A. Bergbreiter, O. B. Alves, H. E. Hoster. Oxidation of the surface shows two distinct reduction waves for platinum oxide at 0.67 $V_{RHE}$ and gold oxide at 1.14 $V_{RHE}$. The reduction wave for platinum oxide at 0.67 $V_{RHE}$ is more pronounced than the reduction wave for platinum oxide at 1.14 $V_{RHE}$. The peak potential for the gold oxide reduction is shifted to more negative values compared to pure gold due to finite size effects. The charge associated with gold oxide formation and reduction on the monolayer platinum film electrode corresponds to about eleven percent (11%) of the gold substrate being accessible to the electrolyte. Even when due consideration is given to the background current for a fully consolidated platinum deposit, the same holds true. These results are also in reasonable agreement with the STM coverage determination.

Similar three-level platinum overlayers have been observed for monolayer films produced by molecular beam epitaxy (MBE) deposition at 0.05 ML/min as discussed by M. O. Pedersen et al. in *Surf. Sci.* 426, 395 (1999). Platinum-gold intermixing driven by the decrease in surface energy that accompanies gold surface segregation was evident. In connection with the present disclosure, platinum monolayer formation may be effectively complete within one second giving a growth rate three orders of magnitude greater than the MBE-STM study. Exchange of the deposited platinum with the underlying gold substrate is expected to be less developed, although intermixing and possible chemical contrast is evident on limited section of the surface particularly evident for surface regions that are that are correlated with the original faulted geometry of the partially reconstructed gold surface.

Figure 3F:
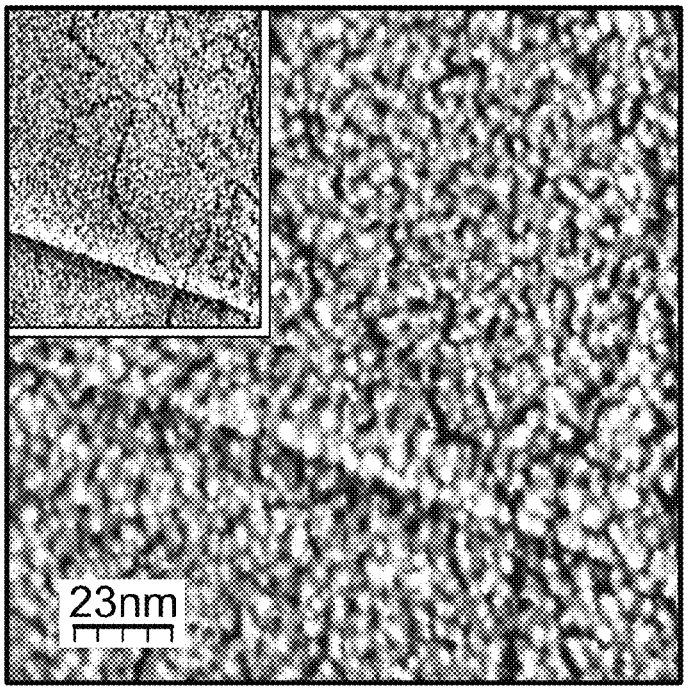
FIG. 3F is an image of linear defects in a platinum layer associated with lifting the reconstructed gold (Au(111)) surface.

Referring now to FIG. 3F, shown is an image of linear defects in a platinum layer associated with lifting the reconstructed gold surface. Upon lifting of the reconstruction, the excess gold atoms expelled mark the original fault location as linear one-dimensional surface defects in the platinum overlayer.

Figure 3G:
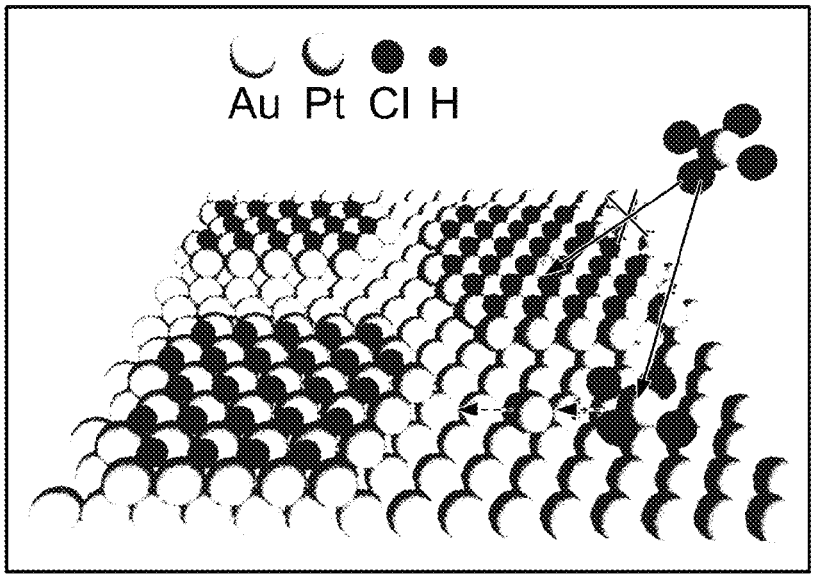
FIG. 3G is a schematic of underpotential deposited hydrogen terminated platinum deposition on gold (Au(111)).

Referring now to FIG. 3G, shown is a schematic of underpotential deposited hydrogen terminated platinum deposition on gold (Au(111)). This schematic shows that the underpotential deposited hydrogen accompanying incremental expansion of the two-dimensional platinum islands hinders the development of a second platinum layer, presumably by perturbation of the overlaying water structure. This rapid process results in a much higher island coverage than has been obtained by other methods such as galvanic exchange reactions.

The saturated coverage of underpotential deposited hydrogen is the agent of termination. Therefore, reactivation for further platinum deposition is possible by removing the underpotential deposited layer by sweeping or stepping the potential to positive values, e.g., >+0.2 $V_{SSCE}$, where negligible platinum deposition occurs. Sequential pulsing between +0.4 and −0.8 $V_{SSCE}$ enables platinum deposition to be controlled in a digital manner. For Pt deposition on Pt, the deposition from the adsorbed precursor ($PtCl_4^{2-}$) occurs directly while solution phase $PtCl_4^{2-}$ and the proton for the underpotential deposition reaction compete directly with one another for the remaining surface sites. The cell time constant associated with the potential step may be used to further tune the relative contribution of these reactions to the actual quantity of Pt deposited.

Figure 4A:
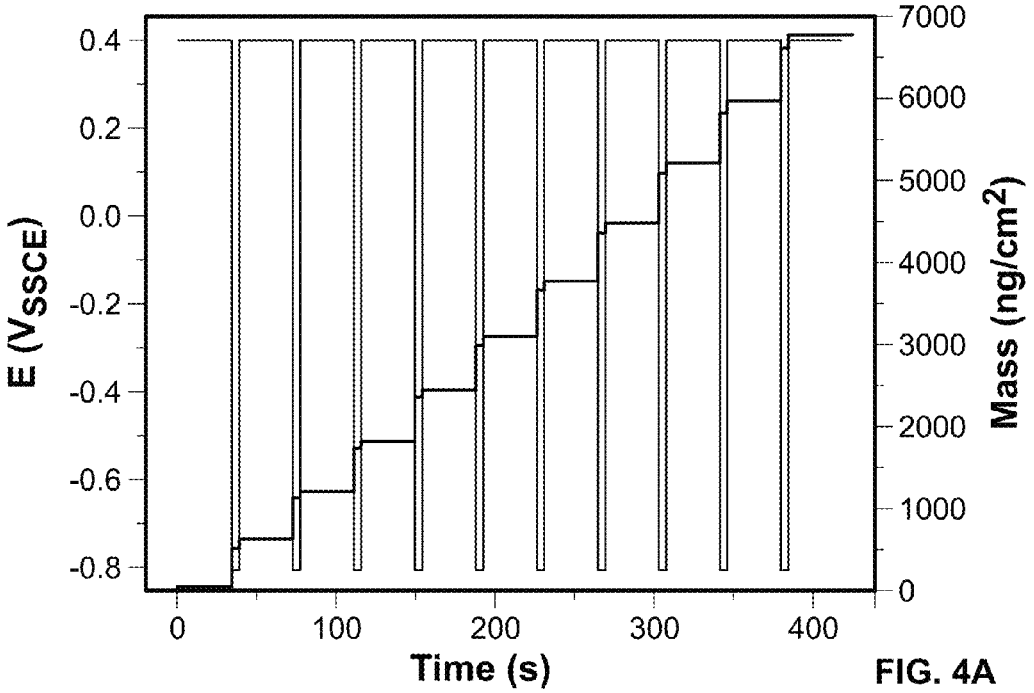
FIG. 4A is a graphical representation of sequential deposition of platinum monoatomic layers by pulsed deposition in a pH 4 solution with EQCM measured mass change accompanying each pulse.

Referring now to FIG. 4A, shown is a graphical representation of sequential deposition of platinum monoatomic layers by pulsed deposition in a pH 4 solution with mass change accompanying each pulse. EQCM was used to track the mass gain showing two net increments per cycle. The mass gain is attributed to a combination platinum deposition (486 ng/$cm^2$ for a monolayer of Pt (111)), anion adsorption and desorption (41 ng/$cm^2$ for $7\times10^{14}$ $Cl^-$ion/$cm^2$, 117 ng/$cm^2$ for a 0.14 fractional coverage of $PtCl_4^{2-}$) and coupling to other double layer components such as water. The anionic mass increments are expected to be asymmetric for the first cycle on the gold surface but once it is covered subsequent cycles only involve platinum surface chemistry. After correcting for the electroactive surface area of the gold electrode ($A_{real}/A_{geometric}$=1.2 derived from reductive desorption of gold oxide in perchloric acid) the net mass gain for each cycle indicates that close to a pseudomorphic layer of platinum is deposited for the given system and cell time constant.

Figure 4B:
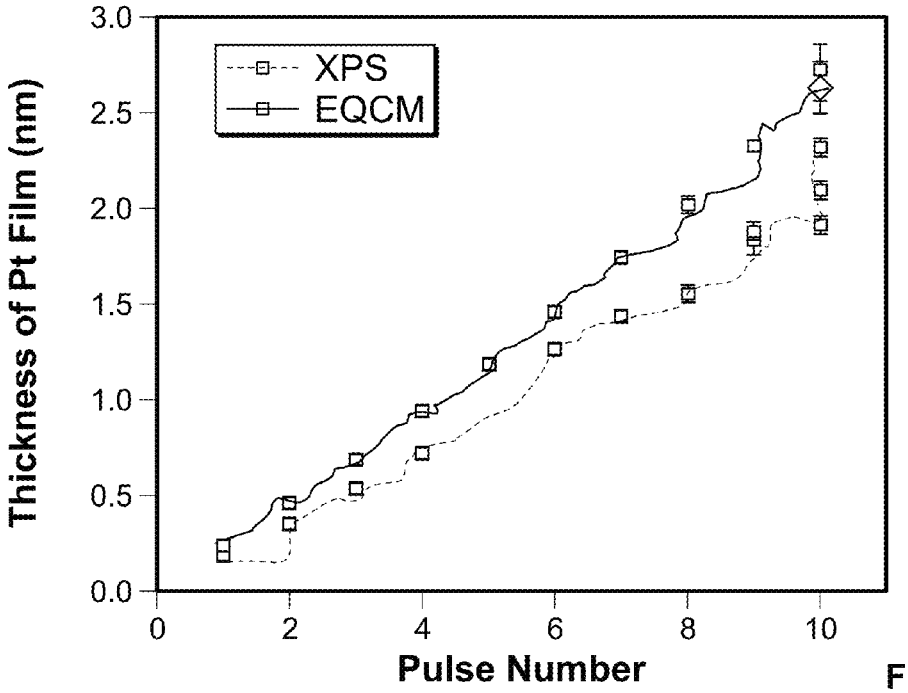
FIG. 4B is a graphical representation of sequential deposition of platinum monoatomic layers by pulsed deposition in a pH 4 solution where EQCM mass increase is converted to thickness and compared with XPS measurements.

Referring now to FIG. 4B, shown is a graphical representation of sequential deposition of platinum monoatomic layers by pulsed deposition in a pH 4 solution where EQCM mass increase is converted to thickness and compared with XPS measurements. XPS analysis of platinum films grown for various deposition cycles gives good agreement with EQCM data. The ability to rapidly manipulate potential and double layer structure, as opposed to exchange of reactants, offers simplicity, substantially improved process efficiency, and far greater process speed than other surface limited deposition methods.

The platinum and platinum alloy monolayer products created using the process described herein can be used in a number of ways. For example, the monolayer(s) may be used as an electrocatalyst, including for the following: (a) alkali water electrolysis; (b) hydrogen oxidation; (c) oxygen reduction reaction; (d) organic fuel oxidation, formic acid, methanol alcohol oxidation and ethanol oxidation. The platinum/platinum alloy monolayers may also be used as a catalyst, e.g., for anodic protection of active-passive metals such as iron group metals, chromium and titanium containing alloys or the monolayers may be used as a hydrogen oxidation catalysis in mitigation of IGSCC (Intergranular Stress Corrosion Cracking) of nickel based and stainless steel alloys. The platinum/platinum alloy monolayer may also be used as a wetting layer to facilitate the subsequent nucleation and growth of other materials by electrochemical or chemical deposition. Another use for the monolayer is as a capping layer to control or influence the magnetic state of an underlying or overlying iron group based (Fe, Co, Ni) magnetic thin film.

While the specification describes particular embodiments of the present invention, those of ordinary skill can devise variations of the present invention without departing from the inventive concept.

We claim:

1. A self-terminating electrodeposition process for controlled growth of platinum monolayer film in an aqueous solution, the process comprising the steps of:

in the aqueous solution, electrodepositing platinum or a platinum alloy onto a substrate such that a saturated underpotential deposited hydrogen layer is formed on the substrate, wherein, as the potential moves negative of an onset of proton reduction potential, a metal deposition reaction among the deposited platinum, the hydrogen layer and the aqueous solution is fully quenched, wherein the aqueous solution contains at least platinum salt; and pulsing the potential from a first value, a positive value at which no metal deposition occurs, to a second value, said second value being a more negative value than the first value, said second value being at least 0.05 V more negative or below the reversible hydrogen electrode potential of said solution, thus enabling formation on the substrate of two-dimensional platinum islands that substantially cover the substrate, said formation being followed by negligible further metal deposition on the substrate.

2. The process of claim 1, further comprising the step of:

at least one additional time, pulsing the potential to at least one additional more positive value, to oxidize the hydrogen layer thus permitting sequential deposition of platinum islands to fabricate platinum films of desired thickness;

wherein the number of pulses correspond to the thickness of formed platinum.

3. The process of claim 2, further comprising the step of:

adjusting a time constant of the electrochemical cell, thereby adjusting the amount of material that is electrodeposited.

4. The process of claim 3, wherein the adjusting step includes changing electrochemical cell dimensions and/or the supporting electrolyte concentration.

5. The process of claim 1, wherein the at least platinum salt is a Pt(II) salt as a metal source in a concentration of about 0.0001 mol/L to about 0.05 mol/L, and the aqueous solution further includes one of more alkali or alkaline earth salts as a supporting electrolyte in a concentration of 0 mol/L to about 3 mol/L.

6. The process of claim 1, wherein the at least platinum salt is Pt(IV) salt as a metal source in a concentration of about 0.0001 mol/L to about 0.05 mol/L and the aqueous solution further includes a supporting electrolyte comprised of one of more alkali or alkaline earth salts in a concentration of 0 mol/L to about 3 mol/L.

7. The process of claim 1, wherein the substrate includes an electrode and the process further comprises the steps of:

terminating the deposition of the platinum or platinum alloy by removing the electrode from the aqueous solution while the potential is applied; and rinsing the platinum or platinum alloy with water.

8. The process of claim 1, further comprising the steps of:

terminating the deposition of the platinum or platinum alloy by stepping the potential to a third value where no platinum dissolution or deposition occurs, the third value being a more positive value than the second value;

removing the platinum or platinum alloy from the aqueous solution; and rinsing the platinum or platinum alloy with water.

9. The process of claim 1, wherein the pH value of the aqueous solution is in the range of 1.0 to 14.0.

10. The process of claim 5, wherein the aqueous solution further includes a pH buffer.

11. The process of claim 6, wherein the aqueous solution further includes a pH buffer.

12. The process of claim 1 wherein the substrate material is an iron group metal or an alloy thereof.

13. The process of claim 1, wherein the substrate material is gold, silver, or copper or an alloy thereof.

14. The process of claim 1, wherein the substrate material is a platinum group metal or an alloy thereof.

15. The process of claim 1, wherein the substrate material is chromium, tungsten, molybdenum or an alloy thereof.

16. The process of claim 1, further comprising:

prior to the electrodepositing step, pretreating the substrate to remove an oxidized surface.

* * * * *